United States Patent [19]

Reimann

[11] Patent Number: 4,482,325

[45] Date of Patent: Nov. 13, 1984

[54] TARGET INDICATING AND SHOT SCORING SYSTEM FOR FIRING RANGE

[76] Inventor: Herbert Reimann, Sandston, Rte. 2, Box 204C, Sandston, Va. 23150

[21] Appl. No.: 380,277

[22] Filed: May 20, 1982

[51] Int. Cl.[3] ..... F41G 3/26

[52] U.S. Cl. ..... 434/21; 273/317; 273/381

[58] Field of Search ..... 273/310–317, 273/85 G, 381, 406, DIG. 28; 434/20–22

[56] References Cited

U.S. PATENT DOCUMENTS

| | | | |
|---|---|---|---|
| 3,104,478 | 9/1963 | Strauss et al. | 273/310 |
| 3,637,212 | 1/1972 | Hurley | 273/316 |
| 3,849,910 | 11/1974 | Greenly | 434/22 |
| 3,948,522 | 4/1976 | Fixler | 273/313 |
| 4,266,776 | 5/1981 | Goldfarb | 273/310 |
| 4,269,415 | 5/1981 | Thorne-Booth | 273/310 |
| 4,427,199 | 1/1984 | Faith | 434/22 |

FOREIGN PATENT DOCUMENTS

| | | | |
|---|---|---|---|
| 431384 | 6/1975 | U.S.S.R. | 273/310 |

OTHER PUBLICATIONS

"Electronic Skeet", pp. 13, 5–79, *Popular Science.*

*Primary Examiner*—Richard C. Pinkham
*Assistant Examiner*—MaryAnn Stoll
*Attorney, Agent, or Firm*—John F. C. Glenn

[57] ABSTRACT

Targets on a shooting range are automatically illuminated individually, either randomly or in a progressive "running" mode, and the firing of shots is sensed and recorded in timed relation to the periods of illumination, for scoring in conjunction with target hits under conditions simulating firing at live targets in the field.

10 Claims, 3 Drawing Figures

TARGET INDICATING AND SHOT SCORING SYSTEM FOR FIRING RANGE

BACKGROUND OF THE INVENTION

Firearm practice on a fixed target merely tests the accuracy of the shooter. It is desirable to add the element of surprise by changing from one target to another, and/or by intermittently making a target active and inactive, and thus to test the shooter's speed of reaction and accuracy under conditions more closely simulating what may actually be experienced in the field by hunters, police, and soldiers. Of course targets can be made to move, but that involves complication and expense, and there has remained a need for a more practical way to provide firing practice against fixed targets which can appear fleetingly and/or simulate movement of a running target.

There is, moreover, a need for a practical set of equipment for such simulated field shooting, such that it is adapted for use with live ammunition on a conventional shooting range having ordinary fixed targets, for use of conventional components to a large extent, and for transportation, installation operation and removal with minimum time and trouble.

SUMMARY OF THE INVENTION

In accordance with the present invention, light is automatically turned on and off at intervals to illuminate briefly a face of one or more targets selected for firing practice. The illumination could be through the back of a translucent target, but it is preferably by reflection of light coming from a source positioned in front of the target but shielded from stray bullets coming from the firing position. The system controlling each light source is set or adjustable to give the shooter time to get ready after starting the system on a new sequence of target practice, and to give appropriate intermittent periods of illumination of one target at a time. Thus, for example, a single target may be intermittently illuminated, or several targets may each be briefly illuminated, either in sequence to simulate a moving target, or not in sequence to simulate independent targets appearing at unexpected positions. The control system is also preferably provided with automatic means of providing random or apparently random control over such variables as timing of illumination of targets and selection of targets to be illuminated. Moreover, the control system has means to record the sound of shots fired during each sequence of target practice, and the timing of periods of illumination of targets, and from such records to determine and display a record of whether each shot was fired while a target was illuminated or not. This can be further correlated with a record of hits on the targets, for the purpose of compiling the score on each sequence of target shots.

In accordance with the invention, it has been found that light bulb and reflector units of the kind used in automobile headlamps make an ideal set of light sources for identifying active targets by light reflection. This, in turn, means that an automobile-type battery can be used to operate the lights and electrical control circuits used with the lights. As a result, the whole set of apparatus needed to convert a conventional fixed target range for use in accordance with the invention, can be reduced to a few readily portable components, which can be transported, installed, used and removed with relatively little trouble. The apparatus of the invention is also advantageous operationally, and has useful application in permanent installations where conventional power sources can be used instead of battery power.

Other features and advantages of the invention will become apparent as the following disclosure proceeds.

BRIEF DESCRIPTION OF THE DRAWINGS

Present preferred embodiment of the invention is shown in the accompanying drawings for purposes of illustration only. In the drawings.

DETAILED DESCRIPTION OF PRESENT PREFERRED EMBODIMENTS

Figure 1:
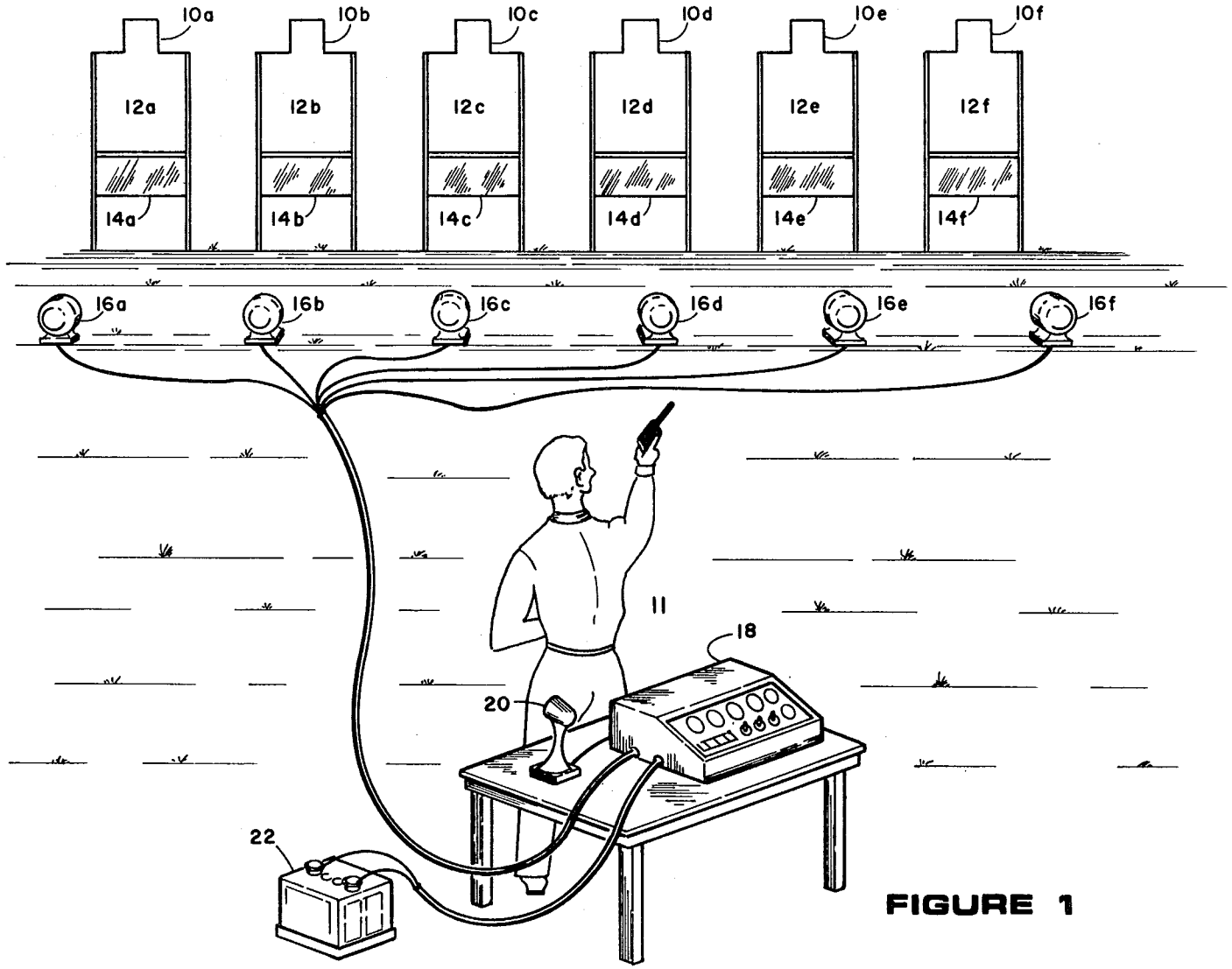
FIG. 1 shows schematically a perspective view of a target range with the apparatus of the invention set up to illuminate the targets and record the sound of shots from the shooting position.

Referring now more particularly to the drawings, a shooting range as illustrated in FIG. 1, having a row of targets 10*a–f* set up to face a firing position 11. The targets have faces 12*a–f* for receiving shots from the firing position, and these faces are preferably divided into zones (not shown) where hits are scored for accuracy of aim. Below the target faces, there are mounted a corresponding series of reflectors 14*a–f*, each preferably consisting of a flat sheet of aluminum foil or vapor-deposited aluminum on film, laminated to paperboard or the like. The reflectors receive light from a corresponding number of light sources, which are preferably in the form of sealed-beam light units 16*a–f* of the kind used for automobile headlamps. These lamps are focused on the respective reflectors and the reflectors are oriented to reflect the light toward the firing position. This means that the reflectors cannot be protected from stray shots, but this problem is dealt with by the inexpensive materials from which the reflectors are made. The lamps, on the other hand, although relatively inexpensive, cost more than the reflectors 14*a–f*, and hence are preferably mounted further out of the line of fire and are also preferably protected by convenient shielding (not shown). The target faces 12*a–f* may be made to coincide with reflectors 14*a–f*, by putting the reflecting material on the faces 12*a–f* instead of on a backing material in another position, as illustrated in FIG. 1. However, this is likely to be more costly, and shooters may prefer not to have to aim directly at a surface reflecting enough light for the purposes of the invention.

A control console 18 and microphone 20 are positioned near the firing position and are powered by an adjacent automobile battery 22. A series of cables separately connect each of the lamps 16*a–f* to console 18. A control panel on console 18 mounts the following controls and recording instruments (shown in FIG. 2):

A switch 24, which controls a selector switch adjustable to limit the number of target lights which will be turned on during a sequence of target lightings (from one up to the design limit of the control unit);

A control 26, which governs a variable resistor adjustable to set the duration of "on" time during which a target is illuminated, such as from one half to five seconds;

A control 28, which governs a variable resistor adjustable to set the duration of "off" time between turning out one of the lamps and turning on the next lamp, such as from one-twentieth of a second to five seconds;

A control 30, which governs a level controller adjustable to control the minimum level of sound to which the microphone 20 will respond, such as the sound level of a gun being fired (for target practice), or else the sound of the click of the hammer of an empty gun (for shooter reaction practice);

A switch 32, which may be turned on or off to activate or deactivate a system of randomly indicating that a lighted target should or should not be shot at (such as by pulsing the light at a perceivable rate of about three-tenths of a second, in one case, and using steady light in the other case, or by signalling with colored lights or sound effects);

Selector switches 34*a* and 34*b*, which are adjustable to set two digits of any number from 0 to 99 and thereby determine how many target lightings will take place during the upcoming shooting course;

A switch 36, which has a first position in which it overrides the variable resistor governed by control 26 and turns on a system of randomly selecting the "on" times of successive lamps within a time range such as one-half of a second to five seconds, and a second position in which it does not override 26 nor turn on said random system;

A switch 38, which has a first position in which it overrides the variable resistor governed by control 28 and turns on a system of randomly selecting the "off" times of successive lamps within a time range such as one-twentieth of a second to ten seconds, and a second position in which it does not override 28 nor turn on said random system;

A button 39, which is a reset button for clearing the counting elements of the control circuit so that no partial counts will remain in the memory when a new course begins;

A button 40, which is a starter button for initiating a sequence of target lightings;

A switch 42, which is movable between a first position in which it produces a short timed delay (such as one second), between pressing the starter button 40 and the first target lighting, and a second position in which such delay is made longer (such as ten seconds), in order to give the shooter time to get ready after pressing starter button 40;

A switch 43, which has a first position in which it causes the target lights to go on in random order, and a second position in which it causes the lights to select targets in sequential order to simulate a running target;

A switch 44, which has a first position in which it causes lights to go on sequentially along a row of targets from left to right, and a second position in which it does the same except for causing the lights to go from right to left, in both cases for simulating a running target but operative only if switch 43 is its above-mentioned second position (the two switches being combinable into a single three position switch, if desired);

A display 46 of a series of indicator lights equal to the number of targets for which the equipment is designed, each light being controlled to show whether a shot was fired while the corresponding target was lighted during a series of target lightings in sequential order (display 46 being replaceable through use of display 52 to provide the same information, as hereinafter described in connection with FIG. 3);

A digital display 48, controlled to show the total number of shots fired while no target was lighted;

A digital display 50, controlled to show the total number of shots fired while a target was lighted and a signal was being given not to fire (if switch 32 is turned on as described above);

A digital display 52, controlled by switch 54; and

A control 54, movable to positions marked to correspond with the number of each of the targets for which the system was designed, and operable at the position for a given target to activate display 52 to show how often each target was lighted during a shooting course in which targets appear at random (switch 43 being in its above-mentioned first position). If switch 32 is turned on, display 52 will not count any lighting of a target while a no-shooting warning signal is in effect.

For the simplest form of competitive shooting on a single target, switch 24 is set for a single target, switches 34*a* and 34*b* are set for the desired number of lights of the target, controls 26 and 28 are set for selected on and off times, switches 32 and 43 are turned off, switches 36 and 38 are switched from their random position to their above-mentioned second positions, switch 42 is turned on if increased delay is desired before target activation begins, and then start up button 40 is pressed to initiate a preset number of uniformly intermittent lightings of the lamp aimed at the reflector next to the single target.

Such single target shooting may be made more demanding by turning switches 36 and 38 to their above-mentioned first positions, so that the intervals of lighting and of pauses between lighting will vary randomly.

For still more difficult shooting, a greater number of targets is used. This will require a resetting of switch 24 to correpond with an additional number of targets, and the number of lightings of targets may be increased by adjustment of switches 34*a* and 34*b*. The sequence of targets that are lighted will remain random as long as switch 43 remains in its random position, and this random effect may be further increased by turning switches 36 and 38 to their random positions, for random variation of the successive periods of on and off lighting of the targets. These random variations raise the level of skill required of the shooter but may not test successive shooters under conditions sufficiently identical for purposes of competition shooting.

The running mode of target operation may be obtained by moving switch 44 to its rightward or leftward running position. It will be necessary to activate variable resistor controls 26 and 28 by turning switches 36 and 38 to their above-mentioned second positions and adjust both controls for time periods, which will, in combination with a selected spacing of the targets, result in a realistic cinematic progress of the lighting from target to target in a way that will be consistent with the image of a target moving at a specified speed.

More severe testing of the shooter's skill is obtained by changing the position of switch 32 so that it will be in its on position during any of the shooting modes just described, with the exception of the running mode. With switch 32 turned on, the lighting of the target will occasionally, in a random fashion, be accompanied by a signal not to shoot, as described above when first mentioning switch 32.

After a sequence of shots has been fired, hits on the marked areas of each target are noted. In the case of scoring a running mode shooting event, where each target was lighted only once, the on or off condition of each individual indicator light of LED row 46 is noted.

If, instead of indicator 46, the digital display 52 is designed to perform the function of 46, each target showing a 1 is noted when dial 54 is turned to the number of that target (as explained in more detail below in connection with counters N1*a–j* shown in FIG. 3. In cases where the firearm used was a submachine gun or a similar fast firing weapon, it is possible to see more than one shot registered to one target. At any rate, only those hits observed at the target which are confirmed with regard to correct timing and target number by one or the other of the above mentioned displays will qualify for scoring. For all other modes of shooting this mode of certifying shots is not practical because targets may have been lighted several times.

Under some conditions, such as operating the targets rapidly in the running mode in bright sunlight, sealed beam headlamps may not give sufficient brightness to the target reflector to be satisfactory to the shooter. Similarly, turning the lamps on and off very rapidly may introduce problems of delayed response due to thermal inertia. If so, a lamp having better characteristics for the purpose may be substituted. Alternatively, to overcome the thermal inertia problem, the lamps may be left on steadily while covering each of them with a set of shutters which can be rapidly opened and shut by electrical means controlled by the lighting control system. Still another remedy would be to provide each lamp with a photocell to sense when light is coming from the lamp, and to use the resultant signals from the photocells to coordinate the on and off timing controls with the actual timing of lights from the lamps.

Figure 3:
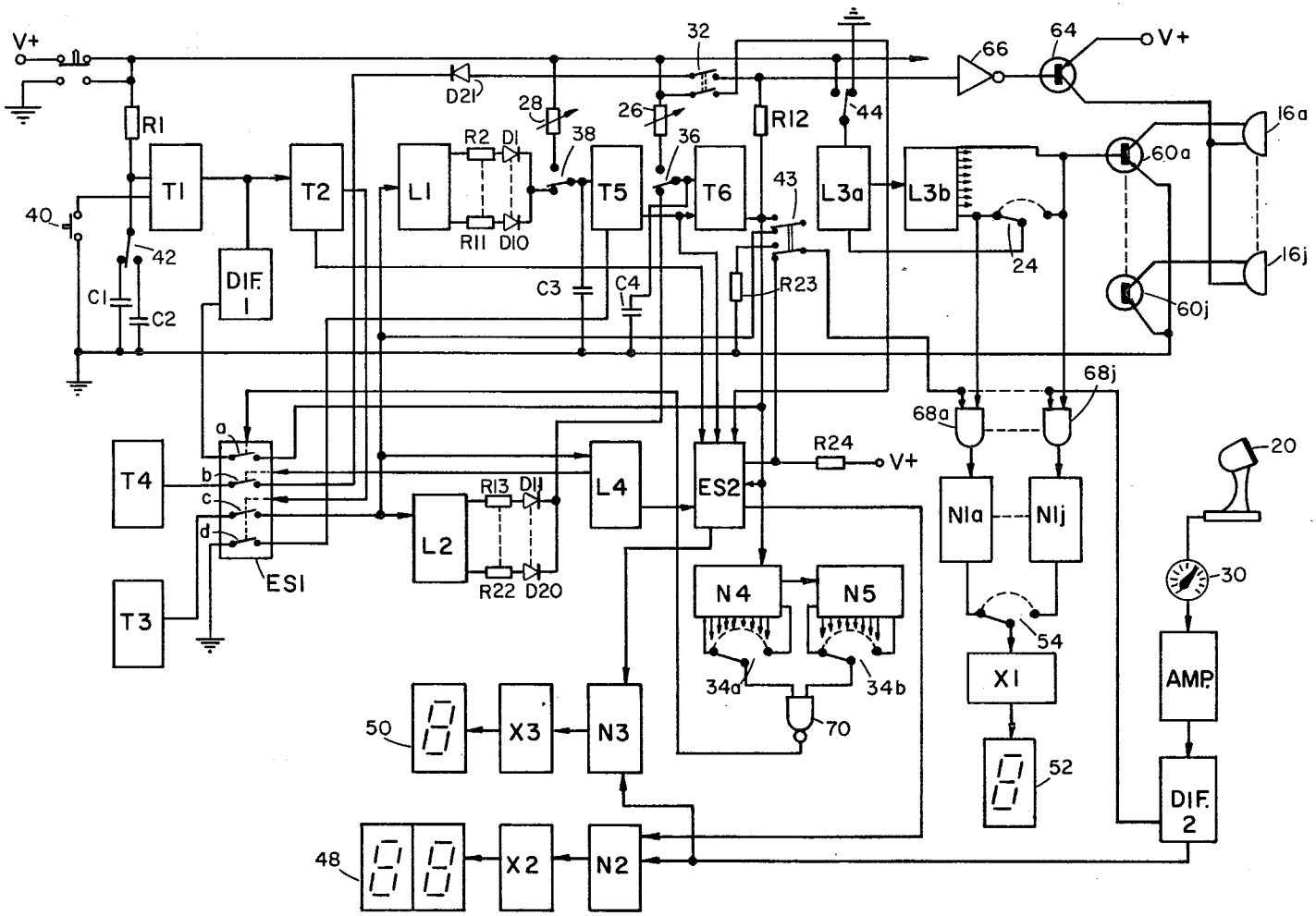
FIG. 3 shows schematically a diagram of electronic circuitry for the central control unit shown in FIG. 1 and its control panel shown in FIG. 2.

Reference is now made to FIG. 3 for a more detailed description of the electronic circuitry. The functions of clocking and timing are carried out by timers T1 through T6, which may be "555" integrated timing circuits, for example, although other suitable semi-conductor configurations may be used. Conventional auxiliary elements of the timers (essentially, a capacitor and resistor), and power supply connections are considered obvious and hence are omitted in FIG. 3, except where the time duration is variable (timers T1, T5 and T6).

The input of timer T1 is connected to resistor R1 and alternative capacitors C1 and C2 selected by switch 42. This provides a choice of two different initial delay times such as one second or ten seconds, selectable by switch 42.

Timer T2 starts and stops within a fraction of a second, such as one-twentieth of a second, and initially is triggered at the beginning of each course of target lightings, when it receives a signal from timer T1 upon completion of its initial delay function. Timer T3 operates continuously during each course of target lightings, and produces a square wave of impulses at high frequency, such as 25 kHz. Hence, there are a calculated 1250 waves emitted by timer T3 during each one-twentieth of a second measured by timer T2. However, the actual number of impulses from timer T3 as measured during any one-twentieth of a second period measured by timer T2 actually varies in a random manner from the calculated number of impulses. Such random variation, such as a fraction of a per cent, can be modified as desired by circuit adjustments well known in the art. This phenomenon is used for purposes of the invention to obtain random timing effects for illuminating targets when a random mode selection is made by switches 36 and 38, as described in more detail below.

While timer T2 is going through its one-twentieth of a second period of operation its output acts on electronic switch ES1, which may be in the form of a "4066" integrated multiple switching circuit containing conduction sets a–d. A control line from timer T2 to ES1 transmits a signal to close conduction sets ES1-c and d during each period of operation of timer T2.

Closing conduction set ES1-d grounds one connection of timer T5 and thereby causes it to start its timing cycle, which is the "off" time for target lighting. When timer T5 completes its cycle, it triggers timer T6, as described below.

Closing conduction set ES1-c connects the square wave output of timer T3 to selectors L1 through L4. These selectors are in the form of counter-decoders, such as "4017" circuits. The square wave impulses from timer T3 are processed in each selector in such manner that each positive impulse at the counter input will be transferred sequentially to one of ten outputs, going back to the first output after reaching the 10th. In a sense, the one-twentieth second cycle of timer T2 may be compared to a spinning roulette wheel, and the counter circuit of the selector as the ball in the spinning wheel which stops at a random position when the wheel comes to a halt. In the case of each of the selectors L1 to L4, one of its outputs will be left with a positive voltage, while the other active outputs remain at zero (ground) level, when timer T2 reaches the end of its one-twentieth second count. In the case of each selector, the outputs are connected to produce varying effects, and it is a matter of chance which output will be left positive to initiate one of these effects, subject to the controlling switch or switches 36 and/or 38 being set to operate in a random mode.

Selector L1 has several outputs, preferably ten, connected to provide a random time interval between turning off one target lamp and turning on another lamp (such as the target lamps 16*a* shown in FIG. 1). This is done by connecting the selector L1 outlets to the respective lamps though a series of resistors R2 through R11, which have resistence values varying successively in geometric progression. These resistors, in conjunction with a capacitor C3 in series with them, are the time determining components of timer T5 and provide varying periods, such as from one-twentieth of a second to ten or fifteen seconds, between turning out the light on one target and starting up the light on the next target. Resistors R2–R11 of selector L1 are also in series with diodes D1 through D10, in order to prevent discharge of capacitor C3 through the nine non-selected resistors.

A similar selector L2 has its input side connected to timer T3 through conduction set ES1-c and its output side connected through similar resistors, diodes, and capacitor to a timer T6, for purposes of determining how long each target lamp stays on. Timer T6 is triggered by timer T5 after its completion of the "off" time. Timer T6 then starts clocking its own randomly predetermined "on" time before the next pause between target lightings begins. At the end of that "on" time, timer T6 sends a signal conduction set ES1-a and differentiator DIF 1 to retrigger timer T2. The function of differentiator DIF 1 is to sense the signal resulting from the extremely fast transition from "on" to "off", and thereupon to emit a signal which will be effective to retrigger timer T2. After timer T2 is retriggered the whole succession of randomly selecting "on" and "off" times and retriggering of timer T2 will be repeated until the end of desired target lightings has been reached and further retriggering of timer T2 is stopped, as described below.

Selector L4 may be of the same general design as L1, L2 or L3 but adjusted to give only one of two outputs, or may be of any other circuitry providing a yes/no choice. The function of L4 is to make a random election whether the lighting of a target will be accompanied by an indication that it should or should not be shot at. If the election is that it should be shot at, the target is lighted steadily while it is on. If the election is that it should not be shot at, the output of L4 closes conduction set ES1-b, and this connects timer T4 (which is continuously generating a square wave of approximately 3 Hz) through diode D21, switch 32 (closed when the L4 election is made) and inverter 66 to switching transistor 64. Since the output signal of "on" timer T6 is reaching inverter 66 through a relatively high resistor R12, timer T4 will override the "on" signal of timer T6 by periodically switching the selected target lamp off, so that its light is flickering instead of steady. Timer T4 is, however, prevented from switching a target lamp on by diode D21. Inverter 66 provides the proper polarity for conduction through transistor 64, which may be of the Darlington or other high input impedance type.

Selector L3 is a counter-decoder in the form of a counter L3*a* and decoder L3*b*, in order to provide a choice of right to left and left to right in the running mode. L3*a* may be a chip 4510 or similar integrated circuit. It's output is in the form of binary coded decimals. L3*b*, which may be a decoding unit 4028 or similar integrated circuit, decodes the output of L3*a* into one of ten outputs from L3*b*. This provides the capability of causing a target lighting sequence go from left to right or from right to left, and to preselect any number of targets up to ten. Other known integrated circuits allow up to 16 selections, and the circuits may be cascaded, by well known means, to select any greater desired number of targets. Switch 24 is adjustable to set the number of target lamps to be lighted, such as the six lamps 16*a–f* shown in FIG. 1, by limiting the number of active outputs from decoder L3*b*. The L3*b* outputs are respectively connected to the control bases of a corresponding group of NPN Darlington transistors 60*a–j*, each of which has its power circuit connected between a post on one of the lamps and ground. The other post on each lamp is connected to a common line from all of the lamps leading through a Darlington transistor 64 to a positive power source indicated at V+(which may be the battery 22 shown in FIG. 1). Current will flow through a lamp only when two conditions are both met. The first condition is that one of the NPN power transistors 60*a–j* connected to the lamp is receiving a positive signal from the corresponding output of decoder L3*b*. The second is that the input of inverter 66 is receiving a positive signal from timer T6, the inverter being used in the circuit to change the positive signals it receives to the ground potential signals required by the PNP power control transistor 64.

Figure 2:
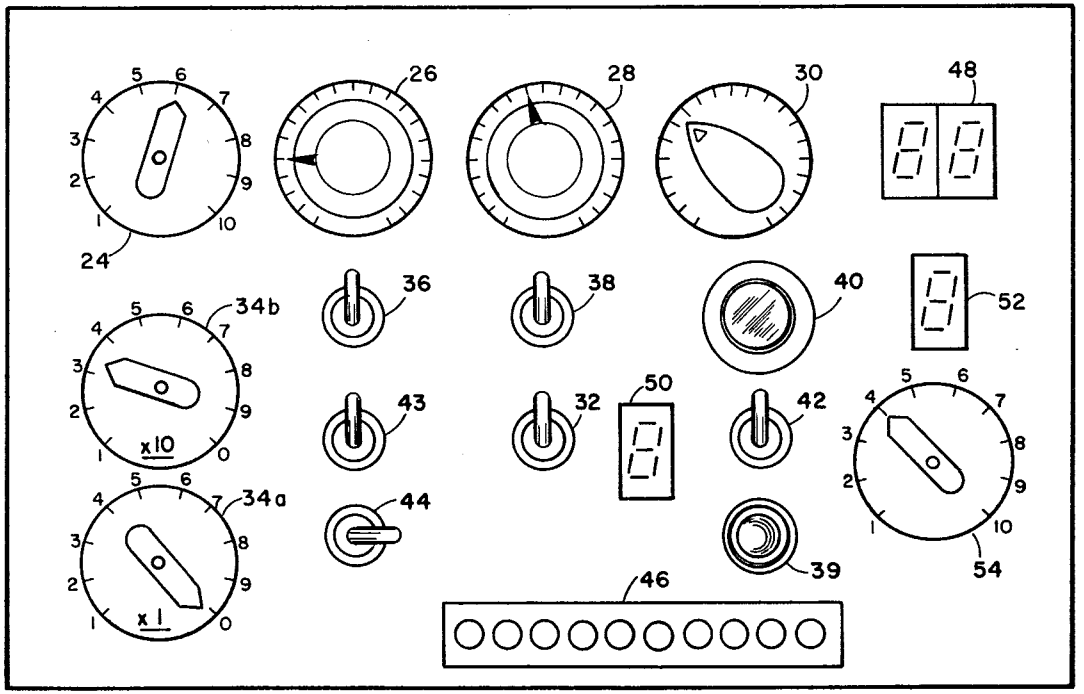
FIG. 2 shows an enlarged and detailed front view of the control and indicator panel of the central control unit of the apparatus shown in FIG. 1.

The outputs of target selector decoder L3*b* are also connected respectively to corresponding AND Gates of 68*a–j* in series with target counters N1*a–j*. These counters are alternately connected through contacts controlled by switch 54 to a decoder-driver X1, which decodes the binary numbers of the counter and causes them to read out as a number on the display 52, which may be selected to show as many numerals as necessary. This reads out how many times each target was lighted as described above when first mentioning dial 54 and is accomplished by connecting input of all AND gates 68*a–j* to positive potential via the lower contact set of switch 43 and resistor R24 while the other input of each gate receives its counting impulse from its respective output of decoder L3*b* for each target. In the running mode the same counter system is also used to validate shots with regard to timing and correct target selection. In this mode one input of all AND gates is connected to ground potential through resistor R23 and the lower contact of switch 32 (as shown in FIG. 3). Each of these counters will count only when both input gates of its AND gates are positive. The first input is a signal to one of these gates that a particular target has been lighted, and the second input is a signal to all of these gates from DIF2 that a shot has been fired. Hence, only the counter for the particular target lighted and fired upon will be counted and thereby registered for scoring purposes. The running mode lighting duration is preferably about one tenth of a second, so that it is unlikely that a semi-automatic pistol, for example, would register more than one shot per target in the running mode. It is thus possible to substitute for the switch operated system discussed here the string of LED lights 46 or the like as shown in FIG. 2. While the gates for counters N1*a–j* may be external, as shown and described, they may instead be internal but accessible as described below in connection with counters N2 and N3.

The microphone 20 is connected through the adjustable level control 30 to an amplifier (shown as AMPL), a differentiator DIF 2, counter N2, decoder-driver X2, and double digit display 48. The readout on display 48 tells the number of shots fired at unlighted targets, as described above when first mentioning control 30.

A second connection from the output of DIF 2 goes to counter N3, decoder-driver X3, and single digit display 50. The readout on display 50 tells the number of shots fired while the target was lighted and a signal was given not to fire (if switch 32 has been closed to its on position).

The enable inputs of counters N2 and N3 are connected to different outputs of an electronic multiple switch ES2. A line from a positive power source (such as battery 22) goes through a resistor R24, a connection to AND gates 68*a–j*, and switch ES2 which connects to ground when closed. When ES2 connects to ground, the AND Gates 68*a–j* are disabled so that counters N1*a–j* do not count while any of the L-series selectors are going through their selection cycles while the controls are set in the non-running mode, in order to avoid false counts. When in the running mode such false counts are prevented from occurring by the closing of the upper contact of switch 43 (as seen in FIG. 3), which connects counter L3*a* directly to timer T6.

Counter N4 is adjustable by operation of dial 34*a*, which has ten positions marked 0 to 9, and counter N4 is similarly controlled by switch 34*b*, to limit the number of target lightings to take place in the upcoming course to any desired number up to a maximum of 99 (or more, by obvious modifications). Switch 34*a* and counter N4 may be set to determine the first digit of the desired number, and switch 34*b* and counter N5 may be set to determine the second digit of the desired number. Counters N4 and N5 are cascade connected to count the total desired number as thus set. The respective contact arms of switches 34*a* and 34*b* are connected to two inputs of NAND gate 70, as shown schematically in FIG. 3. This gate holds conduction set ES1-a closed until the preset desired number of target lightings has been reached. When this happens, as counted by N4 and N5, conduction set ES1-a is opened by a signal from a control line from NAND gate 70, and this interrupts the retriggering sequence originating from the last 37 on" to "off" transition of timer T6, as explained above, and thereby stops the shooting course. The same signal from NAND gate 70 may also trigger an end-of-course message to the shooter (not illustrated).

For conventional scoring purposes, the number of "off" time shots shown on display 48 may be subtracted from the total score of the shooter. Similarly, the shooter's score may be lowered by the number of forbidden shots at lighted targets shown on display 50. In addition, display 52 has a dual use. In the random mode, display 52 records the number of lightings of each target (other than lightings accompanied by a signal not to shoot, and any less number of hits on each target indicates a miss or an improper failure to fire. In the running mode (if display 52 substitutes for LED lights 46 of FIG. 2), the number shown on display 52 for each target indicates whether the target was shot at while lighted, and a hit on such lighted target is scored favorably, while a hit on an unlighted target is not. The disclosed apparatus may readily be adapted to record the total number of shots fired, when that is desired.

While present preferred embodiments and methods of the invention have been illustrated and described, the invention is not limited thereto but may be otherwise embodied and practiced within the scope of the following claims.

I claim:

1. Control and recording apparatus for a firing range having one or more stationary targets for receiving bullets fired with live ammunition, comprising:

an electrical control circuit connectable to a power source and having a series of outlet connections connectable to a corresponding series of lighting means for causing indications of each period when a given target may be fired at, means in the circuit to select one or more of said connections for controlling a desired number of targets, means in the circuit to turn on power to said selected connnections one at a time and with intervals between, sensing means responsive to the sound of a shot, and counting and recording means connected to the circuit and sensing means, said counting and recording means having means to count and show a record of the number of shots that were sensed while any of the selected connnections was in off condition, thereby providing a record of how many shots are fired during non-permitted periods, and thus providing a basis for modifying the scoring of target shooting to take into account the accuracy of timing of shots as well as the accuracy of aim determined by conventional inspection of hits on targets.

2. Apparatus according to claim 1, in which the electrical control means comprises means to cause the selection of the lighting means to be made in a substantially random manner, means alternatively to cause the series of lighting means to be lighted in progressive sequence, and comprising means to switch between activating and deactivating the other of the random selection means and the progressive sequence means.

3. Apparatus according to claim 1 including a row of stationary targets for receiving shots, a position for shooting at the targets, a reflector adjacent each target, means for directing light to each reflector so that the light will be directed toward the firing position, thereby indicating that the target is eligible to be fired upon, and means controlling the light means to cause successive target reflectors to be lighted, whereby a running target is simulated.

4. Apparatus according to claim 1, in which the means to turn on power to the individual connections within the selected group operates substantially randomly in its successive choice of connections, and including means for selecting the total number of times power is turned on in the whole selected group of connnections, and means to count and show how many times each connection has been turned on.

5. Apparatus according to claim 4, in which the control circuit includes:

means operative to modify the supply of power to said connections so that there will be a visible difference between light emissions powered through said connections when said modifying means is operative and when it is not, means for substantially randomly causing said modifying means to be operative during some of the periods when a connection is in on condition, and means to make a separate count and recordation of shots sensed while said modifying means is operative, whereby a friendly target which should not be shot at is simulated while the modifying means is operative and a score is kept for penalizing shots fired at friendly targets.

6. Apparatus according to claim 5, in which the modifying means is operative to introduce pulses into the power supplied to said connections sufficient to cause visible fluctuations of lighting powered through the connections.

7. The apparatus of claim 1, in which the means for turning on power to the selected connections is adapted to do so in a predetermined porgressive sequence such that fixed targets can be progressively indicated to simulate a running target, and in which the counting and recording means is adapted for each connection the number of shots sensed while that connection was in on condition, whereby after running target simulation the number of sensed shots for each target may be compared with the number of hits found on the target for scoring purposes.

8. Apparatus according to claim 7, including a series of lighting means each connected to one of the said outlet connnections, a series of stationary targets adapted to receive bullets and arranged in a row, and a series of light reflectors each adjacent to a target and all aimed to reflect light from the respective lighting means toward a common position from which bullets may be fired at the targets.

9. Apparatus according to claim 8, in which the targets are in a row and the electrical control means comprises means to cause the targets to be lighted in progressive sequence, whereby a moving target may be simulated.

10. Apparatus according to claim 7, including means to cause the sequence of lightings to progress from left to right, and alternatively from right to left.

* * * * *

UNITED STATES PATENT AND TRADEMARK OFFICE

CERTIFICATE OF CORRECTION

PATENT NO. : 4,482,325

DATED : November 13, 1984

INVENTOR(S) : Herbert Reimann

It is certified that error appears in the above-identified patent and that said Letters Patent is hereby corrected as shown below:

Column 9, lines 51-52, "connnections" should read -- connections --.

Column 10, lines 15-16 "connnections" should read -- connections --.

Column 10, line 43, "porgressive" should read -- progressive --.

Column 10, line 45, after "adapted" insert -- to show --.

Signed and Sealed this

*Tenth* Day of *December 1985*

[SEAL]

*Attest:*

DONALD J. QUIGG

*Attesting Officer*

*Commissioner of Patents and Trademarks*